United States Patent [19]

Carlsson et al.

[11] 4,062,008

[45] Dec. 6, 1977

[54] SYSTEM FOR SELECTIVE DETECTION AND INDICATION OF IMPACTS UPON A BASE SURFACE

[75] Inventors: Carl-Eric Waldenburg Carlsson, Eslov; Göran Solve Holmstedt, Lund, both of Sweden

[73] Assignee: Nils Jeppson, Eslov, Sweden

[21] Appl. No.: 656,684

[22] Filed: Feb. 9, 1976

[51] Int. Cl.[2] ..... G08B 21/00

[52] U.S. Cl. ..... 340/323 R

[58] Field of Search ..... 73/12; 116/114 AH; 273/29 A, 184 R; 340/323 R, 258 R; 317/249 R; 361/291

[56] References Cited

U.S. PATENT DOCUMENTS

| | | | |
|---|---|---|---|
| 3,415,517 | 12/1968 | Krist | 340/323 |
| 3,774,194 | 11/1973 | Jokay et al. | 340/323 |
| 3,883,860 | 5/1975 | Kohorn | 340/323 |

FOREIGN PATENT DOCUMENTS

| | | | |
|---|---|---|---|
| 1,234,083 | 6/1971 | United Kingdom | 317/249 |

*Primary Examiner*—James J. Gill

*Assistant Examiner*—Anthony V. Ciarlante

*Attorney, Agent, or Firm*—Beveridge, DeGrandi, Kline & Lunsford

[57] ABSTRACT

A system is provided for selectively detecting and indicating impacts on a base surface, said system comprising at least one detector unit and at least one indicator unit. Said detector unit comprises one or more capacitors between the plates of which an elastic material is inserted, the distance between said capacitor plates as well as the dynamic spring rate of the elastic material being adjusted to the type of impact to be detected and/or the nature of the base surface, and said detector unit is connected to a voltage source via a resistor having high resistance which is chosen with respect to the speed of the impacts to be detected. Said indicator unit comprises an amplifier connected to the detector unit in such a way that each capacitor in the detector unit actuates the indicator unit, said amplifier amplifying pulses from the detector unit, and a switching means which is connected to the output of the amplifier and which, upon receipt of a pulse from the amplifier, delivers a signal to one or more indicator means during a properly adjusted time.

4 Claims, 3 Drawing Figures

SYSTEM FOR SELECTIVE DETECTION AND INDICATION OF IMPACTS UPON A BASE SURFACE

In tennis matches it often is very difficult for an umpire and officials to decide whether a ball bounces on a line mark or touches it, in which case the ball is to be judged "right," whether it bounces outside the line mark, in which case the ball is to be judged "fault." The difficulty lies in that the ball often has such a speed that it is impossible safely to observe with the naked eye the point of impact of the ball and, also, in that the player who is to return the ball often blocks the view for the umpire and officials.

To overcome these difficulties there is needed a system for selective and safe detection and indication of the impacts of the tennis ball on the line marks of the tennis court, the selectivity lying in the detection and indication of ball impacts alone, and not, for instance, foot impacts, on the line marks, and without altering the conditions of the tennis game by changing the bouncing, rebounding or other properties of the ball or the tennis court.

The object of the present invention is to provide such a system which can also be employed for other purposes. As examples of other fields of use may be mentioned the detection and indication of objects passing on a base surface, for instance at various kinds of speed checks, in connection with traffic signals, at traffic census and at various kinds of quality checks.

The invention thus relates to a system of this type, comprising at least one detector unit and at least one indicator unit, wherein said detector unit comprises one or more capacitors between the plates of which an elastic material is inserted, the distance between said capacitor plates as well as the dynamic spring rate of the elastic material being adjusted to the type of impact to be detected and/or to the nature of the base surface, said detector unit is connected to a voltage source via a resistor having high resistance which is chosen with respect to the speed of the impacts to be detected, and said indicator unit comprises an amplifier connected to the detector unit in such a way that each capacitor in the detector unit actuates the indicator unit, said amplifier amplifying pulses from the detector unit, and a switching means which is connected to the output of the amplifier and which, upon receipt of a pulse from the amplifier, delivers a signal to one or more indicator means during a properly adjusted time.

The invention will now be described in more detail with reference to the accompanying drawings which illustrate an embodiment of the invention intended for tennis courts and in which.

Figure 1:
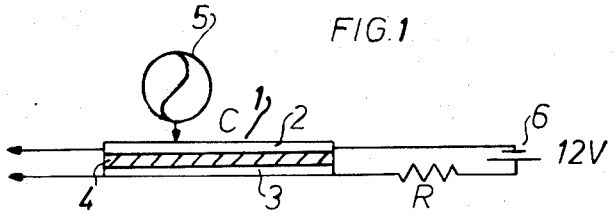
FIG. 1 shows a detector unit connected to a voltage source.

As illustrated in FIG. 1, a detector unit 1 comprises a capacitor C between the plates 2, 3 of which an elastic material 4 is inserted. The distance between the capacitor plates 2, 3 as well as the dynamic spring rate of the elastic material 4 are adjusted to the type of impact to be detected and/or to the nature of the base surface. In this case the system is intended, as already mentioned, for use in tennis courts, for detecting and indicating the impacts of the tennis ball 5 on the line marks of the tennis court and therefore said distance and spring rate are so chosen that the tennis ball 5, when falling freely from a height corresponding approximately to the height of the tennis court net and hitting a line mark, changes to the desired degree the distance between the capacitor plates 2, 3 and, consequently, the capacitance of a capacitor C which is arranged, as will be described below, in conjunction with the line mark, and that the bounce of the tennis ball 5 on the line will not be altered by the arrangement of the capacitor C. The elastic material 4 is such that, due to its damping ability, it reduces the inherent oscillations of the capacitor after a bounce. The detector unit is connected to a 12 V battery 6 via a resistor R having high resistance which is chosen with respect to the speed of the impacts to be detected. The resistance of the resistor R is in this case chosen so as to provide a rapid system and thus a selective detection, resulting in the detection of ball bounces and not of e.g. foot impacts on the line mark.

When the tennis ball 5 hits a line, the capacitance of the capacitor C changes, as mentioned above. The time constant for charging the capacitor is large in relation to the bouncing time, which means that the charge of the capacitor remains substantially constant. The change of capacitance then causes a change of voltage across the capacitor, which change is transferred to an indicator unit.

The detector unit 1 may comprise several capacitors which form detector segments having each a length of about 1–2 m. Each detector segment is laid out in or on the tennis court in conjunction with a certain predetermined line mark or part of it so as to cover this line or part. The segments should be laid out along the line mark but at some intervals so as to permit thermic dilatation. The distance between the segments must not, however, be so large as to allow a tennis ball to bounce on the line mark between two detector segments without being detected. Thus, when the segments have been laid out in this way the detector unit corresponds to and covers a certain predetermined line mark or part of it. Groups of detector segments are laid out in this fashion so that all the line marks or parts thereof correspond to some of the detector units. A suitable distribution of detector units are apparent from FIG. 3. The side lines for doubles and the base lines correspond each to one detector unit. That portion of each side line for singles, which is situated between the two service lines, and the center service line correspond each to one detector unit. Further, on either side of the net, the portions of the service line belonging respectively to the right service court and to the left service court, and the remaining portions of the respective side lines for singles correspond each to one detector unit.

Figure 2:
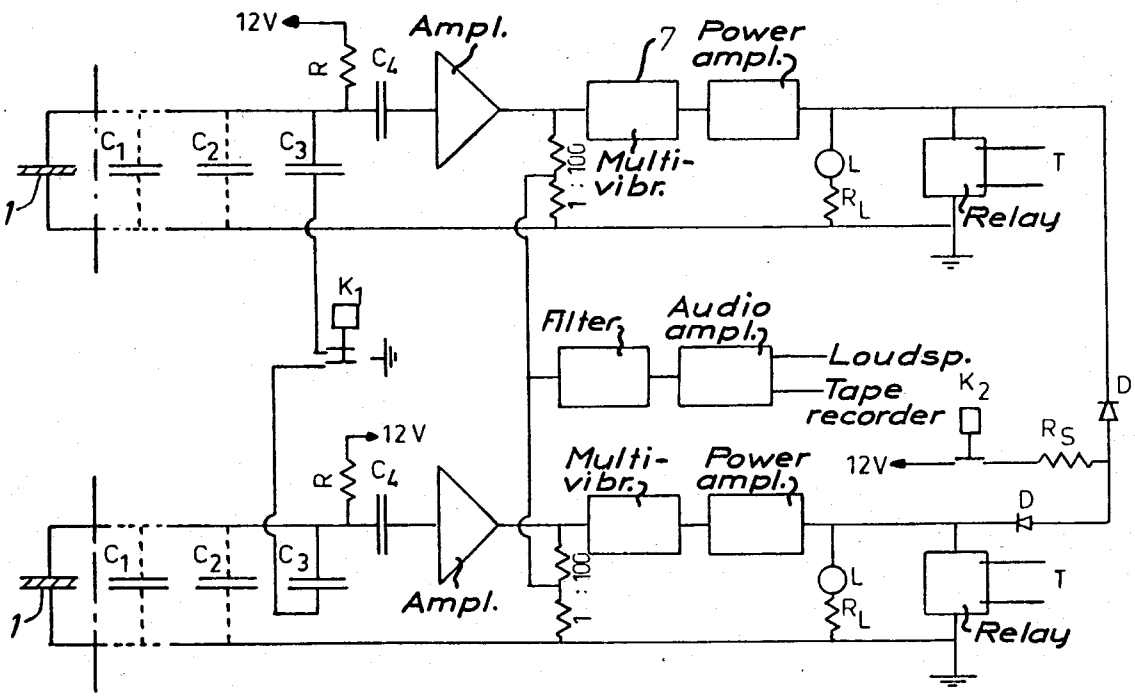
FIG. 2 shows a schematic block diagram for the system.

Each detector unit corresponds to an indicator unit to which the detector unit is connected in such a way that each capacitor may actuate the indicator unit. The construction of the indicator unit is apparent from FIG. 2 which shows two detector units 1 and two identical indicator units to which the respective detector unit is connected via a coupling capacitor $C_4$. The indicator unit comprises an amplifier which amplifies pulses from the detector unit, a switching means 7, in the form of a monostable multivibrator, connected to the output of the amplifier, said multivibrator having a change-over time properly adjusted to the type of indicator instrument used and being connected to a power amplifier the output of which forms a first tap from the indicator unit, and a voltage divider connected to the output of the amplifier and forming a second tap from the indicator unit. The indicator unit according to the present embodiment also comprises a light diode L connected to the first tap and having a resistor $R_L$ for limiting the current through the light diode, a relay which likewise is connected to the first tap and the output T of which is connected to an indicator panel according to FIG. 3, which is intended for the tennis public, and an audio-amplifier, including loudspeaker and tape recorder output, which is common to all the indicator units and connected to the second tap via a low-pass filter. The indicator unit also includes a unit $K_2$, $R_S$, D, common to all the indicator units, for checking light diodes and the indicator panel, said checking unit comprising a switching means $K_2$ which is connected to a voltage source and coupled in series with a resistor $R_S$ and a diode D, said checking unit being connected to the light diodes and the relays. The indicator unit finally includes a unit for testing the whole indicator unit, said testing unit consisting of a capacitor $C_3$ which can be connected in parallel with the detector unit 1 by a switching means $K_1$. $C_1$ designates the capacitance in the connecting cables of the detector units and $C_2$ designates capacitors designed for damping radio interferences.

Figure 3:
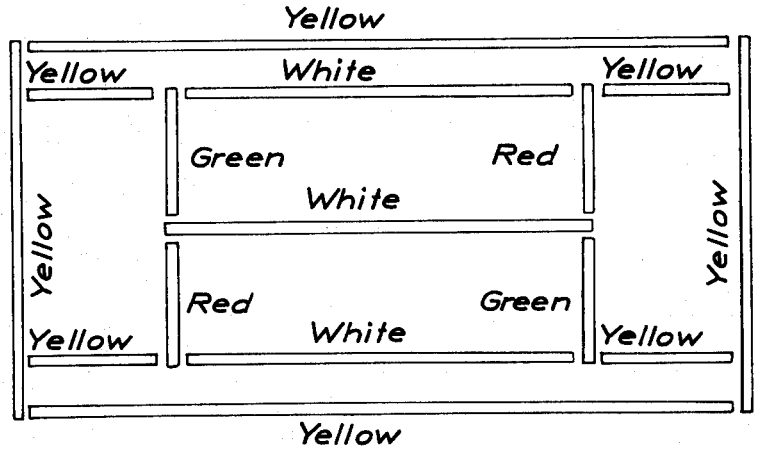
FIG. 3 shows an indicator panel employed in the system.

FIG. 3 illustrates an indicator panel on which all the line marks of the tennis court are reproduced by means of lamps which may be of different color in accordance with FIG. 3. The indicator panel is connected to the relay outputs T in such a way that each lamp is coupled to the corresponding detector unit via the respective indicator unit. This indicator panel may be intended for the tennis public, and a similar though smaller indicator panel, on which e.g. the light diodes represent the line marks, may be intended for the umpire.

The system described functions as follows: The tennis ball 5 hitting part of a line mark causes, in the manner described above, a change of voltage across the capacitor covering the line mark part in question. This voltage pulse is transmitted via the coupling capacitor $C_4$, which eliminates the d.c. voltage level, to the amplifier of that indicator unit which corresponds to the detector unit in which the capacitor is included. The gain of this amplifier determines, together with the elastic material in the capacitor, the lower limit of the impact power required to permit detection and indication. This lower limit of the impact power must not exceed the impact power produced by a tennis ball falling freely from a height corresponding to the height of the net. The signal amplified by the amplifier actuates the multivibrator the change-over time of which determines the lighting time of the light diode and the lamp which are connected to the power amplifier and which indicate on the indicator panels the impact of the ball on the line mark, and via the voltage divider and the low-pass filter it also actuates the audio-amplifier so that the impact of the ball on the line mark is also heard in a loudspeaker connected to the audioamplifier. This sound indication may also be recorded by means of a tape recorder connected to the audio-amplifier. It should be noticed in this connection that the feedback obtained by means of the common acoustic unit must fall below the discriminator level that a signal has to exceed if to permit light indication.

What we claim and desire to secure by Letters Patent is:

1. A system for selectively detecting and indicating momentary impacts on a base surface, said system comprising at least one detector unit and at least one indicator unit, wherein said detector unit comprises one or more capacitors between the plates of which an elastic material is inserted, the distance between said capacitor plates as well as the dynamic spring rate of the elastic material being adjusted to the type of impact to be detected and to the nature of the base surface, said detector unit being connected to a voltage source via a resistor having a sufficiently high resistance such that the charge on said one or more capacitors remains substantially constant during the duration of the impacts to be detected, and said indicator unit comprises an amplifier connected to the detector unit in such a way that each capacitor in the detector unit actuates the indicator unit, said amplifier amplifying pulses from the detector unit, and a switching means which is connected to the output of the amplifier and which, upon receipt of a pulse from the amplifier, delivers a signal to at least one indicator means for a desired time.

2. A system as defined in claim 1, wherein the indicator unit comprises a light diode connected to the switching means.

3. A system as defined in claim 1, designed for selectively detecting and indicating the impacts of a tennis ball on the line marks of a tennis court, said apparatus comprising a plurality of detector units connected each to one indicator unit, wherein the capacitors in each detector unit jointly correspond to at least a portion of a predetermined line mark and have such an area that they, when laid out on the tennis court, cover said portion of said line mark and the detector units, when laid out, cover all the line marks of the tennis court.

4. A system as defined in claim 3, comprising an indicator panel on which the line marks of the tennis court are reproduced by means of light generating units connected to the respective indicator units.

* * * * *